US011939867B2

(12) United States Patent
Mueller et al.

(10) Patent No.: US 11,939,867 B2
(45) Date of Patent: Mar. 26, 2024

(54) DOWNHOLE DIRECTIONAL DRILLING TOOL

(71) Applicant: Schlumberger Technology Corporation, Sugar Land, TX (US)

(72) Inventors: Andrew Mueller, Sugar Land, TX (US); Dennis Patrick Chesnutt, Katy, TX (US); Ke Chen, Houston, TX (US); Xiaoge Gan, Houston, TX (US); Venkatesh Karuppiah, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 186 days.

(21) Appl. No.: 17/310,625

(22) PCT Filed: Feb. 14, 2020

(86) PCT No.: PCT/US2020/018227
§ 371 (c)(1),
(2) Date: Aug. 13, 2021

(87) PCT Pub. No.: WO2020/168157
PCT Pub. Date: Aug. 20, 2020

(65) Prior Publication Data

US 2022/0112770 A1 Apr. 14, 2022

Related U.S. Application Data

(60) Provisional application No. 62/805,977, filed on Feb. 15, 2019.

(51) Int. Cl.
*E21B 7/06* (2006.01)

(52) U.S. Cl.
CPC ..... *E21B 7/062* (2013.01)

(58) Field of Classification Search
None
See application file for complete search history.

(56) References Cited

U.S. PATENT DOCUMENTS 6,484,825 B2 * 11/2002 Watson ..... E21B 7/064 175/406
8,066,085 B2 11/2011 Johnson et al.
8,534,380 B2 9/2013 Sheppard et al.
8,720,604 B2 5/2014 Sheppard
8,727,036 B2 5/2014 Johnson
(Continued)

FOREIGN PATENT DOCUMENTS

WO 2011002993 A2 1/2011

OTHER PUBLICATIONS

International Search Report and Written Opinion issued in International Patent application PCT/US2020/018227 dated Jun. 23, 2020, 18 pages.

(Continued)

*Primary Examiner* — Taras P Bemko

(57) ABSTRACT

A downhole tool has a directional pad that contacts a wellbore wall at a pad contact location and a drill bit with at least one active cutting element that contacts the wellbore wall at a cutting element contact location. A contact distance between the pad contact location and the cutting element contact location being 3 in. (7.6 cm) or less.

19 Claims, 8 Drawing Sheets

(56) References Cited

U.S. PATENT DOCUMENTS

| | | | | |
|---|---|---|---|---|
| 8,757,294 | B2 | 6/2014 | Johnson et al. | |
| 8,763,726 | B2 | 7/2014 | Johnson et al. | |
| 8,899,352 | B2 | 12/2014 | Johnson et al. | |
| 10,597,942 | B2 | 3/2020 | Caresta | |
| 11,118,406 | B2 | 9/2021 | Caresta et al. | |
| 2002/0079139 | A1 | 6/2002 | Mensa-Wilmot et al. | |
| 2009/0044977 | A1 | 2/2009 | Johnson et al. | |
| 2009/0044980 | A1* | 2/2009 | Sheppard | E21B 7/06 175/24 |
| 2009/0188720 | A1* | 7/2009 | Johnson | E21B 7/06 175/76 |
| 2011/0015911 | A1 | 1/2011 | Chen | |
| 2011/0253457 | A1 | 10/2011 | Shen et al. | |
| 2014/0014413 | A1* | 1/2014 | Niina | E21B 7/06 175/76 |
| 2015/0107902 | A1 | 4/2015 | Downton | |
| 2018/0283103 | A1* | 10/2018 | Caresta | E21B 47/00 |
| 2019/0316420 | A1* | 10/2019 | Russell | E21B 10/602 |
| 2020/0003010 | A1* | 1/2020 | Bittleston | E21B 7/062 |
| 2020/0003011 | A1 | 1/2020 | Sihler et al. | |
| 2020/0141188 | A1* | 5/2020 | Marshall | E21B 47/024 |
| 2022/0112770 | A1* | 4/2022 | Mueller | E21B 7/062 |

OTHER PUBLICATIONS

International Preliminary Report on Patentability issued in International Patent application PCT/US2020/018227, dated Aug. 10, 2021, 11 pages.

* cited by examiner

DOWNHOLE DIRECTIONAL DRILLING TOOL

CROSS-REFERENCE TO RELATED APPLICATIONS

This application is the U.S. national phase of International Patent Application No. PCT/US2020/018227, filed Feb. 14, 2020, and entitled, "Downhole Directional Drilling Tool" which claims the benefit of, and priority to, U.S. Patent Application No. 62/805,977 filed on Feb. 15, 2019, which is incorporated herein by this reference in its entirety.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

The wellbores may be drilled by a drilling system that drills through earthen material downward from the surface. Some wellbores are drilled vertically downward, and some wellbores have one or more curves in the wellbore to follow desirable geological formations, avoid problematic geological formations, or a combination of the two.

SUMMARY

In some aspects, a downhole tool includes a directional pad configured to contact a wellbore wall at a pad contact location and a drill bit having at least one active cutting element. The at least one active cutting element contacts the wellbore wall at a cutting element contact location, and a contact distance between the pad contact location and the cutting element contact location being 3 in. (7.6 cm) or less.

According to some aspects, a downhole tool includes a directional pad configured to contact a wellbore wall at a pad contact location and a drill bit having at least one active cutting element. A contact ratio between a bit diameter and a contact length between the pad contact location and the at least one active cutting element being greater than 3:1.

According to further aspects, a downhole tool includes a directional pad configured to contact a wellbore wall at a pad contact location and a drill bit having at least one active cutting element. A directional pad angle between the contact location and the at least one active cutting element relative to the longitudinal axis is greater than 0° and less than or equal to 5°.

Additional aspects include a downhole tool having a directional pad configured to contact a wellbore wall at a pad contact location and a drill bit having a first active cutting element and a second active cutting element. The first active cutting element is located further uphole than any other cutting element and the second active cutting element is located further uphole than any other cutting element except the first active cutting element. An angle between the first active cutting element and the second active cutting element being greater than 0° and less than or equal to 5°.

This summary is provided to introduce a selection of concepts that are further described below in the detailed description. This summary is not intended to identify key or essential features of the claimed subject matter, nor is it intended to be used as an aid in limiting the scope of the claimed subject matter. Rather, additional features and aspects of embodiments of the disclosure will be set forth in the description which follows, and in part will be obvious from the description, or may be learned by the practice of such embodiments. The features and aspects of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 12-1 is a perspective view of another assembly tool usable to connect a drive shaft to a drill bit, according to at least one embodiment of the present disclosure; and FIG. 12-2 is a perspective view of the assembly tool of FIG. 12-1, with the drill bit removed.

DETAILED DESCRIPTION

This disclosure generally relates to devices, systems, and methods for a downhole directional drilling tool.

Figure 1:
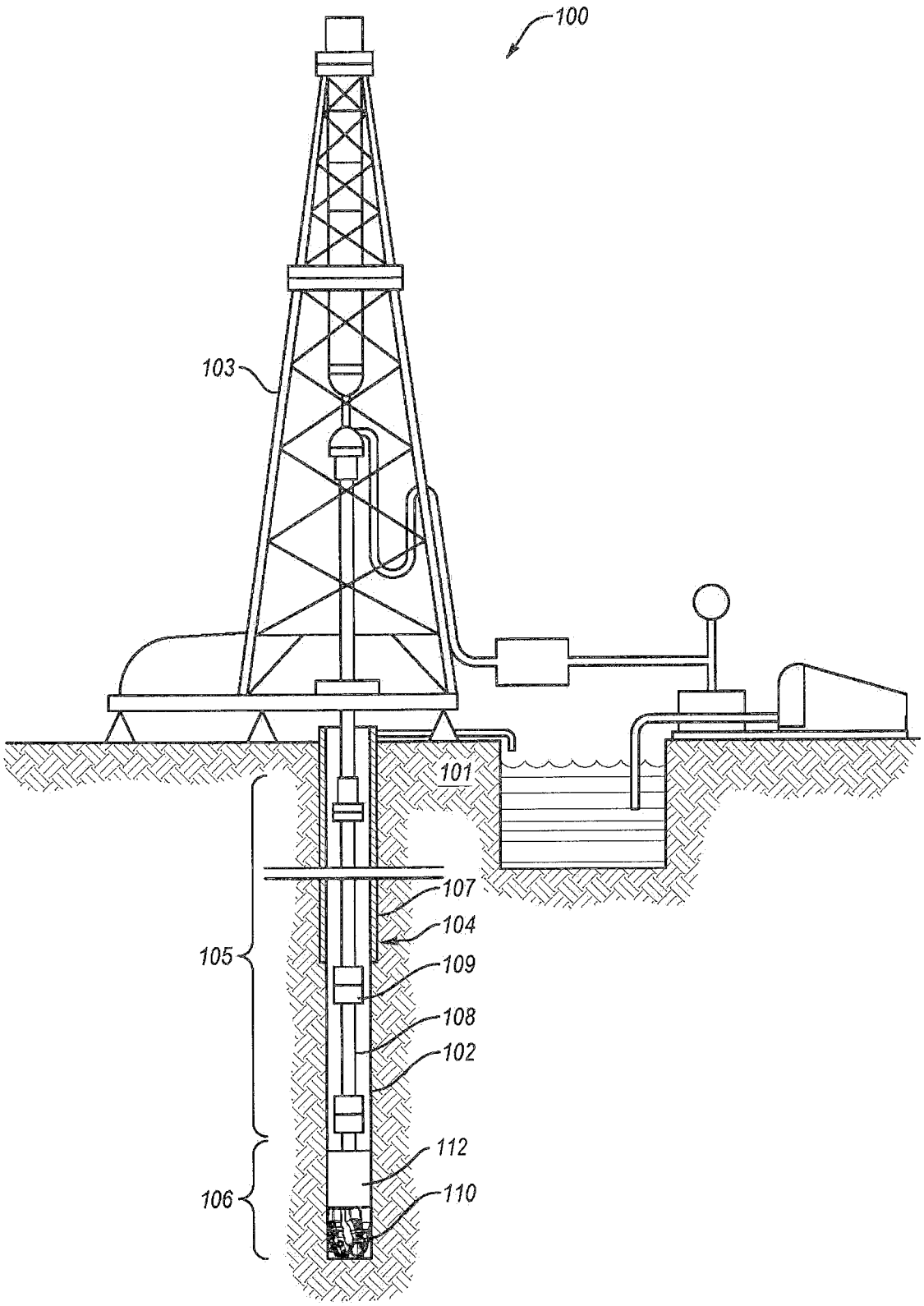
FIG. 1 is a representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 a connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. Swarf or other cuttings formed by use of a mill may be lifted to surface, or may be allowed to fall downhole. The bit 110 may be guided by a directional drilling assembly 112.

Figure 2:
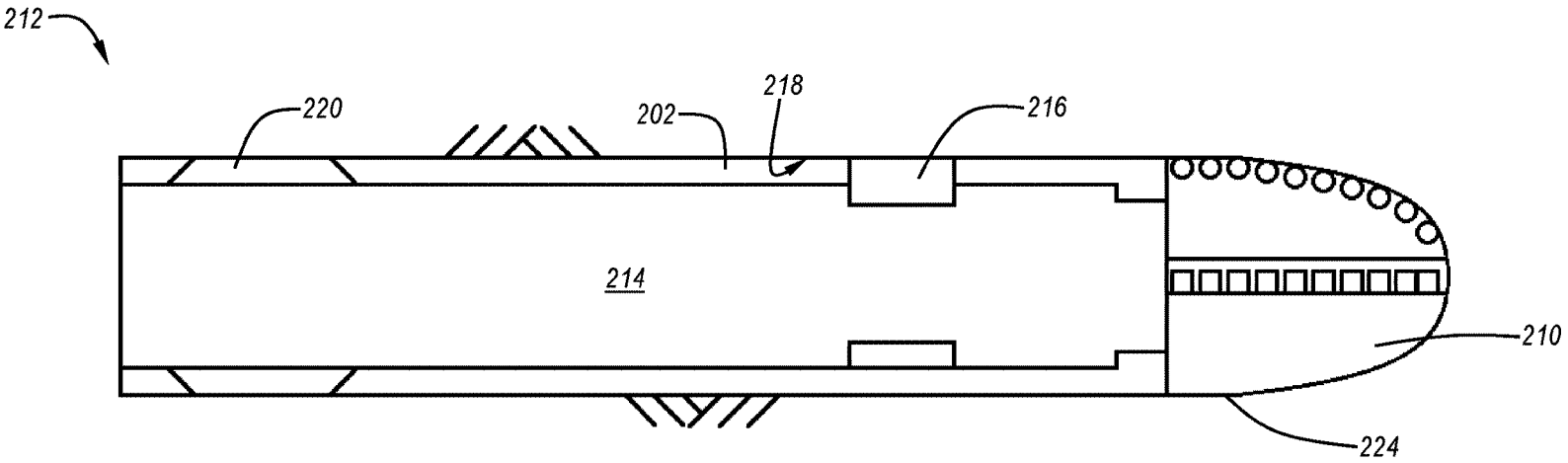
FIG. 2 (Prior Art)
FIG. 2 is a representation of a prior art directional drilling system.

FIG. 2 is a representation of a prior art directional drilling assembly 212 including a bit 210. The bit 210 may be connected to a directional drilling sub 214 having one or more selectively directional pads 216 configured to contact a wall 218 of the wellbore 202. The directional pads may be expandable, such as where the directional drilling sub 214 is a rotary steerable system. As the directional pads 216 selectively expand and contact the wall 218, the bit 210 experiences a greater force at a bit contact location 224 on an opposite side of the wall 218, thereby forcing a radial deflection, or dog leg, of the wellbore 202. The bit 210 is stabilized by a contact of the stabilizer 220 with the wall 218 at a stabilizer contact location, thereby encouraging a consistent radial deflection, or dog leg severity (DLS). The DLS is increased the closer the directional pads 216 are located to the bit contact location 224. In the shown directional drilling assembly 212 (e.g., including a rotary steerable system), the internal structural mechanics of selectively extending the directional pads 216 limits how close to the bit 210 the directional pads 216 may be placed. As shown, the distance between the directional pads 216 and the bit contact location 224 is large. For example, as shown the distance between the directional pads 216 and the bit contact location 224 is greater than 12 in. (30.5 cm).

Figure 3:
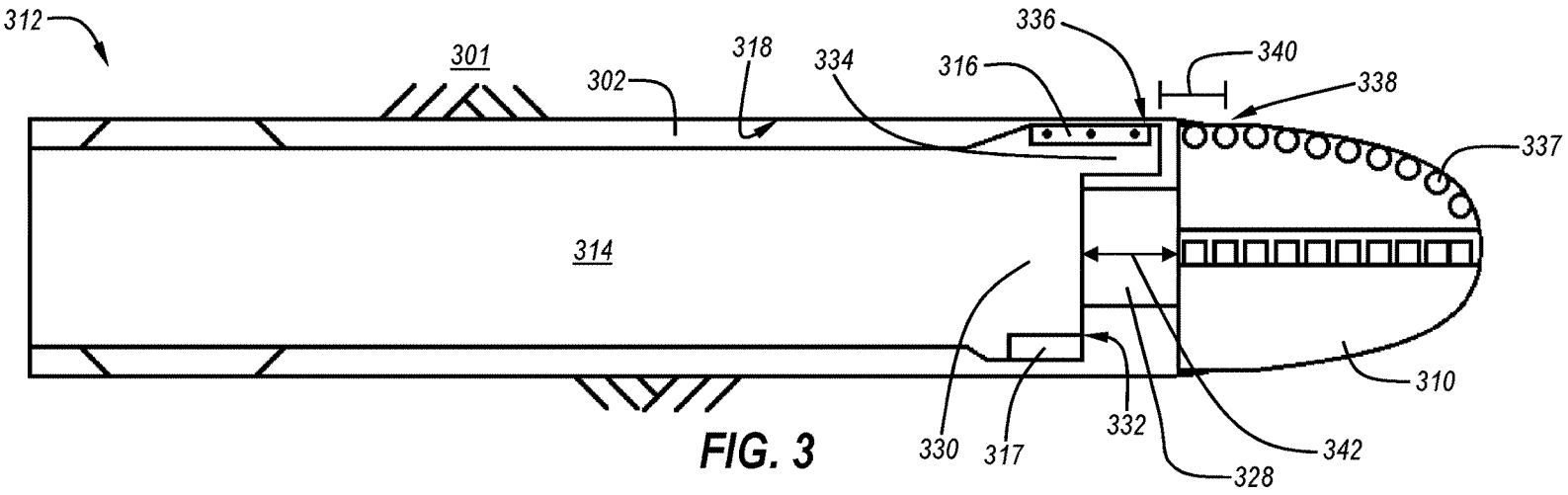
FIG. 3 is a representation of a directional drilling system, according to at least one embodiment of the present disclosure.

FIG. 3 is a representation of an embodiment of a directional drilling assembly 312. A bit 310 may be connected to a directional drilling sub 314 with a bit connection 328. A directional pad 316 may be connected to a downhole end of the directional drilling sub 314. The directional pad 316 may be located or housed in directional pad housing 330 located on the directional drilling sub 314. In some embodiments, the directional pad 316 (and optionally the portion of the directional pad housing 330 supporting the directional pad 316) may be located on or toward the lower end of the directional drilling sub 314, and may extend past a downhole end 332 of the directional pad housing 330 and/or the directional drilling sub 314. In particular, a distance referred to as an overhang 334 is shown as the distance the directional pad 316 (and/or associated portion of the directional pad housing 330) extends past, or overhangs, the downhole end 332 of another portion of the directional pad housing 330.

As shown in FIG. 3, the portion of the directional pad housing 330 at which downhole end 332 is located may be directly opposed to the directional pad 316; however, this is not limiting. In the same or other embodiments, the downhole end 332 may be the downhole end of a portion of the directional pad housing 330 supporting a second pad 317. In some embodiments, the second pad 317 does not extend axially as far downhole as the direction pad 316. In the same or other embodiments, the second pad 317 also may extend radially from the portion of the directional pad housing 330. The amount of radial extension of the second pad 317 may vary, and in some embodiments the distance between a longitudinal axis of the directional pad housing 330 and the outer surface of the second pad 317 is less than the distance between the longitudinal axis of the directional pad housing 330 and the outer surface of the directional pad 316. In further example embodiments, the distance between the longitudinal axis of the directional pad housing 330 and the outer surface of the second pad 317 may be less than or equal to a cutting element radius at the final cutting element contact location 338.

In some embodiments, the second pad 317 is a discrete component attached to the directional pad housing 330. In other embodiments, the second pad 317 is integrally formed with the directional pad housing 330 (see FIG. 4). Further, any number of second pads 317 may be used. For instance, in at least some embodiments, the directional pad housing 330 includes or is attached to one directional pad 316 and two, three, four, or more second pads 317.

The directional pad 316 may engage or contact the wall 318 of the wellbore 302 at a pad contact location 336. Cutting elements 337 located on the bit 310 may engage the formation 301, degrading or cutting the formation 301 to form the wellbore 302. Some of the cutting elements 337 are active cutting elements 337, meaning that they actively engage and remove the formation 301, or cut a path through the formation 301. At least one of the active cutting elements 337 may be at a position defining a final active cutting element contact location 338. In some embodiments, a contact length 340 between the pad contact location 336 and the final cutting element contact location 338 may directly influence the DLS achievable using the directional drilling assembly 312. In other words, a shorter contact length 340 may increase the DLS, and a longer contact length 340 may decrease the DLS.

In some embodiments, the bit 310 may rotate independently of, or relative to, the directional pad housing 330. In other words, the bit 310 may be driven by a downhole motor (not shown), such as a mud turbine or a Moineau pump. The directional pad 316 may retain an absolute angular orientation (e.g., relative to a gravitational force and/or a cardinal direction such as magnetic north). As the wellbore 302 advances, the directional pad 316 may slide along the wellbore wall 318, constantly pushing the bit 310 opposite the pad contact location 336. Thus, the directional drilling assembly 312 may form a dog leg by slide drilling. The direction of the dog leg may be changed by rotating the directional pad housing 330. Moreover, the magnitude of DLS can be adjusted by adjusting by switching between the drilling modes from sliding to rotating.

At least a portion of a downhole tool (such as a downhole motor drive shaft, not shown) extends from the downhole end 332 of the directional pad housing 330 to form the bit connection 328. The bit connection 328 may extend a connection length 342, thereby moving (e.g., extending) the directional pad housing 330, and potentially the directional pad 316, away from the bit 310. In some embodiments, including an overhang 334 extending or protruding past the downhole end 332 of another portion of the directional pad housing 330 may allow the directional pad 316 to be positioned closer to the drill bit 310, without interfering with the bit connection 328. In this manner, the contact length 340 may be decreased, thereby increasing the DLS.

Figure 4:
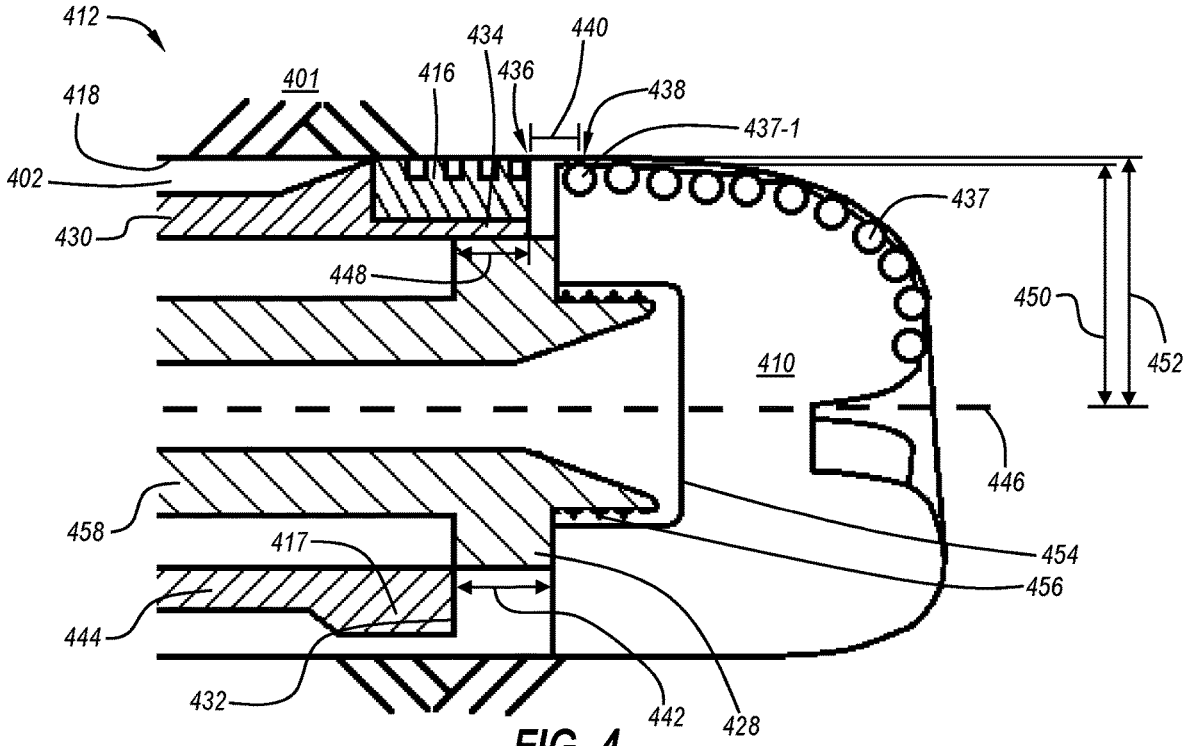
FIG. 4 is a cross-sectional view of a directional drilling system, according to at least one embodiment of the present disclosure.

FIG. 4 is a cross-sectional view of an embodiment of a portion of a directional drilling assembly 412. In some embodiments, the directional drilling assembly 412 may be an enlarged view of a portion of the directional drilling assembly 312 of FIG. 3.

In FIG. 4, a bit 410 is connected to a downhole tool 444 at a bit connection 428. A directional pad 416 may be attached to a directional pad housing 430, and the directional pad 416 may contact the wall 418 of the wellbore 402 at one or more pad contact locations 436. In some embodiments, the directional pad 416 contacts the wall 418 in a single location, or at a point location, or along a single line. In other embodiments, the directional pad 416 may contact the wall 418 over an area of the directional pad 416. In some embodiments, there is a significant contact area, such as half, a majority, or an entirety of the area of the outer surface of the directional pad 416. The pad contact location 436 may be the downhole-most location where the directional pad 416 contacts the wall 418.

The bit 410 may include a plurality of cutting elements 437. Some of the cutting elements 437 may be active cutting elements 437. Active cutting elements 437 are cutting elements that actively degrade and remove a volume of the formation 401 while the bit 410 rotates and weight on bit is applied downhole. Thus, a cutting element that is uphole of a cutting element at a greater or equal radial distance may not be considered an active cutting element 437 as the volume that could be removed by that cutting element may be removed by the time the cutting element is moved to the location of the removed rock. Rather, such a cutting element may instead be used to protect gauge, stabilize the bit, or for backreaming, rather than for active cutting while advancing the drill bit 410.

A final active cutting element 437-1 may be the uphole-most active cutting element 437. Accordingly, the final active cutting element 437-1 may be located further uphole than every other active cutting element 437 of the plurality of cutting elements 437. In some examples, the final active cutting element 437-1 element may be the furthest uphole cutting element 437. In other examples, one or more cutting elements 437, which are not active, may be uphole of the final active cutting element 437. For instance, one or more cutting elements 437 may be used for backreaming when the bit 410 is removed from the borehole.

The final active cutting element 437-1 may engage the formation 401 at a final cutting element contact location 438 and remove a volume of rock from the formation 401. The final cutting element contact location 438 may be at approximately the center (e.g., longitudinal center for cylindrical shaped cutters) of the final active cutting element 437-1, measured lengthwise down a longitudinal axis 446 of the directional drilling assembly 412. Thus, the contact length 440 may be the distance between the pad contact location 436 and the final cutting element contact location 438. In the illustrated embodiment, the contact length 440 may be the distance between the downhole-most location where the directional pad 416 contacts the wall 418 and the center of the final active cutting element 437-1.

In some embodiments, the contact length 440 may be in a range having a lower value, an upper value, or lower and upper values including any of 0.25 in. (0.6 cm), 0.5 in. (1.3 cm), 0.75 in. (1.9 cm), 1.0 in. (2.5 cm), 1.25 in. (3.2 cm), 1.5 in. (3.8 cm), 1.75 in. (4.4 cm), 2.0 in. (5.1 cm), 2.25 in. (5.7 cm), 2.5 (6.4 cm), 2.75 in. (7.0 cm), 3.0 in. (7.6 cm), 4.0 in. (10.2 cm), 5.0 in. (12.7 cm), 6.0 in. (15.2 cm), 7.0 in. (17.8 cm), 8.0 in. (20.3 cm), or any value therebetween. For example, the contact length 440 may be greater than 0.25 in. (0.6 cm). In other examples, the contact length 440 may be less than 8.0 in. (2.3 cm). In still other examples, the contact length 440 may be any value in a range between 0.25 in. (0.6 cm) and 8.0 in. (2.3 cm). In other examples, the contact length 440 may be less than 6.0 in. (15.2 cm). In still other examples, the contact length 440 may be less than 3.0 in. (7.6 cm). In at least some embodiments, contact lengths 440 of less than 3.0 in. (7.6 cm) may be critical to achieve a desired DLS increase of the directional drilling assembly 412.

In some embodiments, the maximum DLS achievable by the directional drilling assembly 412 may be in a range having a lower value, an upper value, or lower and upper values including any of 1° per 100 ft. (30 m), 2° per 100 ft. (30 m), 3° per 100 ft. (30 m), 4° per 100 ft. (30 m), 5° per 100 ft. (30 m), 6° per 100 ft. (30 m), 7° per 100 ft. (30 m), 8° per 100 ft. (30 m), 9° per 100 ft. (30 m), 10° per 100 ft. (30 m), or any value therebetween. Some analysis has further been done to show that the maximum DLS achievable by the directional assembly 412 may even exceed 10° per 100 ft. (30 m), and may even be up to 20° per 100 ft. (30 m), up to 25° per 100 ft. (30 m), up to 40° per 100 ft. (30 m), or even up to 60° per 100 ft. (30 m).

Accordingly, the maximum DLS may be greater than 1° per 100 ft. (30 m), greater than 10° per 100 ft. (30 m), greater than 20° per 100 ft. (30 m), greater than 30° per 100 ft. (30 m), or greater than 40° per 100 ft. (30 m). In the same or other examples, the maximum DLS may be less than 60° per 100 ft. (30 m), less than 50° per 100 ft. (30 m), less than 40° per 100 ft. (30 m), less than 25° per 100 ft. (30 m), less than 20° per 100 ft. (30 m), or less than 10° per 100 ft. (30 m). In still other examples, the maximum DLS may be any value in a range between 1° per 100 ft. (30 m) and 25° per 100 ft. (30 m), or any value in a range between 1° per 100 ft. (30 m) and 60° per 100 ft. (30 m).

Similar to the directional drilling assembly 312 of FIG. 3, the directional drilling assembly 412 can include a directional pad 416 that extends a distance to have an overhang 434 relative to, and beyond, a downhole end 432 of a portion of the directional pad housing 430. The downhole end 432 is illustrated as downhole end of a portion of the directional pad housing 430 aligned with, supporting, or part of a second pad 417. The second pad 417 may be opposite the directional pad 416 (i.e., angularly offset by 180° in the illustrated embodiment); however, in other embodiments the second pad 417 may be offset from the directional pad 416 by less than 180° (e.g., 90° or 120°).

In some embodiments, an overhang distance 448 between the downhole end of the directional pad 416 and the downhole end 432 of the other portion of the directional pad housing 430 may be the same as, or less than, the distance 442 between the downhole end 432 and an uphole end of the drill bit 410. For instance, the overhang 434 may extend across an entirety of a shank portion of the bit connection 428. The shank portion of the bit connection 428 may remain outside the bit 410 when made-up to the drill bit 410 as described herein. In these or other embodiments, the contact length 440 may be zero or close to zero (e.g., less than the diameter of the final active cutting element 437-1). In some embodiments, the contact length 440 may be a percentage of a connection distance 442. The connection distance 442 may be the distance between the downhole end 432 of the other portion of the directional pad housing 430 and the uphole end of the drill bit 410. In some embodiments, the connection length 442 corresponds to the length of the shank portion of the bit connection 428.

The overhang distance 448 may be related to the connection length 442 by an overhang percentage. In some embodiments, the overhang percentage (i.e., percentage of the overhang distance 448 to the connection length 442) may be in a range having a lower value, an upper value, or lower and upper values including any of 10%, 25%, 40%, 50%, 60%, 70%, 80%, 90%, 95%, 100%, or any value therebetween. For example, the overhang percentage may be greater than 10%. In other examples, the overhang percentage may be less than 100%. In still other examples, the overhang percentage may be any value in a range between 10% and 100%.

The bit 410 has a bit diameter, which may also be referred to as the gauge diameter. The bit diameter is twice the bit radius 450 shown in FIG. 4. In some embodiments, the bit diameter may be any diameter used in drilling wellbores, including bit diameters between 4 in. (10.2 cm). and 24 in. (61.0 cm). In some embodiments, the bit diameter is between 6 in. (15.2 cm) and 13 in. (33.0 cm) or between 8 in. (20.3 cm) and 9 in. (22.9 cm). A contact ratio can be defined as a ratio of the bit diameter to the contact length 440. For example, the contact ratio may be greater than 3:1. In other examples, the contact ratio may be 4:1. In still other examples, the contact ratio may be between 20:1 and 2:1. For instance, the contact ratio may be 33:2, 10:1, 9:1, 17:2, 8:1, 35:6, 5:1, 9:2; 8:3, or any other combination of bit diameter to contact length 440. A higher contact ratio may, in some cases, increase the maximum DLS of the directional drilling assembly 412.

The directional pad 416 of FIG. 4 has a pad radius 452 measured from the longitudinal axis 446 of the directional drilling assembly 412. In some embodiments, the pad radius 452 is equal to or greater than the bit radius 450. For instance, the pad radius 452 may be equal to the bit radius 450. In other embodiments, the pad radius 452 may be greater than the bit radius 450. For instance, the bit radius 450 may be a final active cutting element radius, and the pad radius 452 may be greater than the final active cutting element radius. In some embodiments, the pad radius 452 is between 100% and 150%, between 100% and 120%, between 101% and 115%, or between 101% and 110% of the bit radius 450. Increasing the pad radius may increase the force applied to the wall 418 of the wellbore 402 during use, and a greater force applied to the wall 418 may increase the DLS of the directional drilling assembly 412. In some embodiments, the directional pad 416 may be radially fixed relative to the longitudinal axis 446. For instance, the directional pad 416 may be a fixed pad that does not extend, expand, or otherwise actuate, such that the pad radius 452 remains constant. In the same or other embodiments, the second pad(s) 417 may also be fixed pads rather than extendable or actuatable pads.

In some embodiments, the bit 410 is rotated relative to the directional pad housing 430 by the downhole tool 444. For example, the downhole tool 444 may include a drive shaft such as a drive shaft from a downhole motor, such as a turbine or a positive displacement motor (e.g., a Moineau pump). The directional pad housing 430 may maintain a desired a rotational orientation during drilling, including an orientation relative to the force of gravity, and/or an orientation relative to magnetic or true north. For instance, the directional pad housing 430 may be used for slide drilling. In some embodiments, the directional pad housing 430 and the directional pad 416 may be rotationally fixed relative to the longitudinal axis 446. In other embodiments, the directional pad housing 430 may be rotated, thereby changing the direction of the dog leg of the directional drilling assembly 412. In some embodiments, the directional pad 416 may be a singular directional pad 416. In other words, the directional pad housing 430 may have a single (e.g., only one) directional pad 416. Where the directional pad housing 430 has one or more directional pads 416, the directional pad housing 430 may include one or more other or second pads 417 having a different configuration. The second pads 417 may not materially contribute to the directional tendencies of the directional pad housing 430. For instance, the second pads 417 may have radial reach (and optionally reduced axial reach) relative to the directional pads 416, such that the second pads 417 can act more like a stabilizer while the directional pad(s) 416 steer the directional drilling assembly 412.

In some embodiments, the bit 410 may include a box connection 454. The box connection 454 may be a hollow portion inside of the bit 410 configured to connect to the downhole tool 444 at a pin connection coupled to the bit connection 428. In some examples, the box connection 454 and the bit connection 428 may connect via threads 456, where the box connection 454 has the female end of the threaded connection 456, and the bit connection 428 has the male end of the threaded connection 456. The threaded connection may be single shoulder connection, such as an API connection. In some embodiments, the threaded connection is a double shoulder connection or premium connection, such as a proprietary connection or licensed connection. When the drill bit 410 is made-up to the downhole tool 444, fluid flowing through a central bore 458 of the downhole tool 444 (e.g., in the drive shaft) may flow into the drill bit 410 and through one or more ports or nozzles in the body of the drill bit 410. The threaded connection 456 may allow sufficient room in the drill bit body to allow the ports or nozzles that will provide total flow sufficient to clean and cool the cutting structure of the drill bit 410 while drilling formation.

Figure 5:
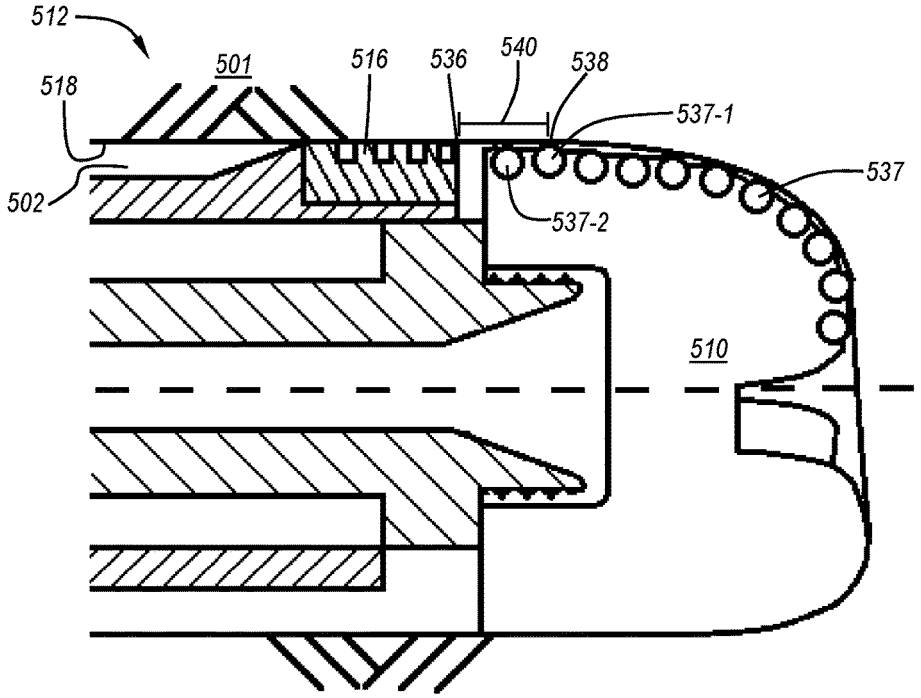
FIG. 5 is another cross-sectional view of a directional drilling system, according to at least one embodiment of the present disclosure.

FIG. 5 is another cross-sectional view of an embodiment of a directional drilling assembly 512. In some embodiments, a directional pad 516 may contact or engage a wall 518 of a wellbore 502 at a pad contact location 536. A bit 510 has a plurality of cutting elements 537, some of which are active cutting elements 537 which engage and remove formation 501. A final active cutting element 537-1 may be an uphole-most active cutting element 537. In other words, the final active cutting element 537-1 may be the furthest uphole active cutting element 537 of all active cutting elements 537. As shown in FIG. 5, in at least some embodiments, the final active cutting element 537-1 may not be the furthest uphole cutting element 537. One or more inactive cutting elements 537-2 may be located uphole of the final active cutting element 537-1. In some embodiments, the one or more inactive cutting elements 537-2 may be located on the same blade as the final active cutting element 537-1. In other embodiments, the one or more inactive cutting elements 537-2 may be located on a different blade from the final active cutting element 537-1. Thus, as described above, a contact length 540 may be measured from the pad contact location 536 to a final active cutting element contact location 538.

Figure 6:
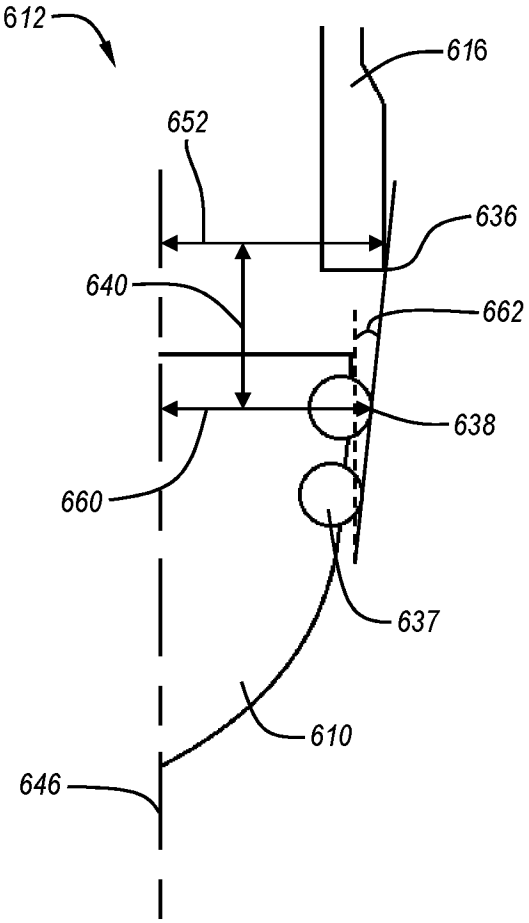
FIG. 6 is a partial side view of a bit, according to at least one embodiment of the present disclosure.

FIG. 6 is a representation of a section of a directional drilling assembly 612, according to at least one embodiment of the present disclosure. A directional pad 616 may be located uphole of a bit 610 that includes a plurality of cutting elements. In some embodiments, the plurality of cutting elements include an active gauge cutting element 638 and an active adjacent-to-gauge cutting element 637. The directional pad 616 optionally has an outermost surface at a pad radius 652 greater than that the gauge radius 660 at an outermost cutting tip of the active gauge cutting element 638, as measured relative to a longitudinal axis 646 of the bit 610. Thus, a directional pad angle 662 may exist between the pad contact location 636 and the final cutting element contact location of the active gauge cutting element 638, relative to the longitudinal axis 646. In some embodiments, the directional pad angle 662 may be in a range having a lower value, an upper value, or lower and upper values including any of 0.0°, 0.1°, 0.5°, 1.0°, 1.5°, 2.0°, 2.5°, 3.0°, 3.5°, 4.0°, 4.5°, 5.0°, or any value therebetween. For example, the directional pad angle 662 taper radially inwardly from the directional pad 616 to the active gauge cutting element 638 at an angle greater than 0.0° and/or less than 5.0°. In still other examples, the directional pad angle 662 may be any value in a range between and/or between and including 0.0° and 5.0°. In other embodiments, the angle may be greater than 5.0°. In some embodiments, relatively higher directional pad angles 662 may increase the DLS as compared to relatively smaller directional pad angles 662 that can decrease the DLS.

In some embodiments, the contact length 640 may be less than 3 in. (7.6 cm), and the directional pad angle 662 may be between 0.0° and 5.0° or between 0.5° and 3.5°. The combination of contact length 640 and directional pad angle 662 may further increase the DLS and/or improve control over the accuracy or precision of the DLS.

Figure 7:
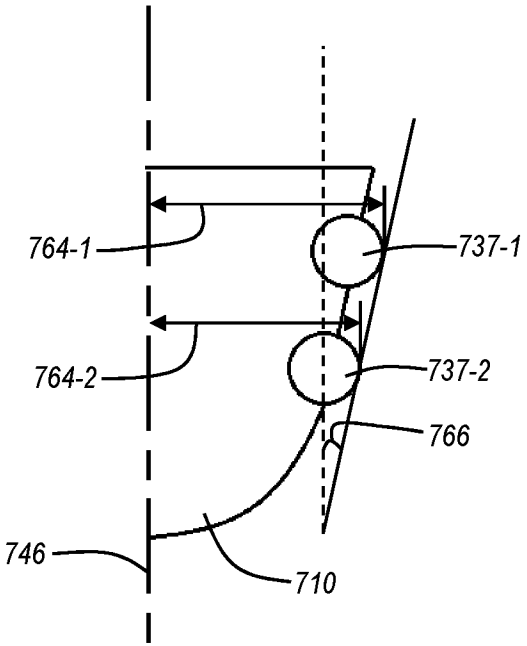
FIG. 7 is another partial side view of a bit, according to at least one embodiment of the present disclosure.

FIG. 7 is a representation of a section of a bit 710, according to at least one embodiment of the present disclosure. The bit 710 may include a plurality of cutting elements, including an active gauge cutting element(s) 737-1 and an active adjacent-to-gauge cutting element(s) 737-2. In FIG. 7, the cutting elements 737-1, 737-2 illustrate cutting element positions in a composite cutting profile in which all cutting elements are aligned in the same blade. Thus, multiple discrete cutting elements can be located at a same cutting element position and would show as a single cutting element. Where multiple cutting elements show as a single cutting element in the cutting profile view, the cutting element position is considered to have redundancy.

In some embodiments, the active gauge cutting element(s) 737-1 is located farther uphole than every other cutting element of the plurality of cutting elements (or farther uphole than every other active cutting element of the plurality of cutting elements), including the active adjacent-to-gauge cutting element(s) 737-2. The active adjacent-to-gauge cutting element(s) 737-2 are located farther uphole than every other cutting element of the plurality of cutting elements except the active gauge cutting element(s) 737-1. In some embodiments, an active gauge cutting element 737-1 and an active adjacent-to-gauge cutting element 737-2 are located on the same blade of the bit 710. In other embodiments, a blade may include one, but not both, of an active gauge cutting element 737-1 and an active adjacent-to-gauge cutting element 737-2.

The active gauge cutting element 737-1 has a first cutting element radius 764-1 relative to a longitudinal axis 746 of the bit 710. The active adjacent-to-gauge cutting element 737-2 has a second cutting element radius 764-2 relative to the longitudinal axis 746. In some embodiments, the second cutting element radius 764-2 may be different than the first cutting element radius 764-1. In this manner, a cutting element angle 766 is formed between the first cutting element 737-1 and the second cutting element 737-2. In some embodiments, the cutting element angle 766 may be in a range having a lower value, an upper value, or lower and upper values including any of 0.05°, 0.1°, 0.5°, 1.0°, 1.5°, 2.0°, 2.5°, 3.0°, 3.5°, 4.0°, 4.5°, 5.0°, or any value therebetween. For example, the cutting element angle 766 may be greater than 0.05°. In other examples, the cutting element angle 766 may be less than 5.0°. In still other examples, the cutting element angle 766 may be any value in a range between 0.0° and 5.0°, between 0.1° and 4°, or between 1° and 3°.

In some embodiments, the second cutting element radius 764-2 may be smaller than the first cutting element radius 764-1. Thus, a negative cutting element angle 766 is formed. In other words, the gauge of the bit may have a negative, or inward, taper in a downhole direction. A negative cutting element angle 766 may enable the upper cutting elements, on the gauge of a drill bit, to more fully engage the formation (e.g., formation 301 of FIG. 3) when the directional pad (e.g., directional pad 316 of FIG. 3) causes an increased force against one side of the bit 710.

In some embodiments, the cutting element angle 766 may be the same as the directional pad angle (e.g., directional pad angle 662 of FIG. 6). This may further enable an even force distribution or cutting volume across multiple active cutting elements 737-1, 737-2 as the bit 710 is pushed by the directional pad. In other embodiments, the cutting element angle 766 may be greater than or less than the directional pad angle.

Figure 8:
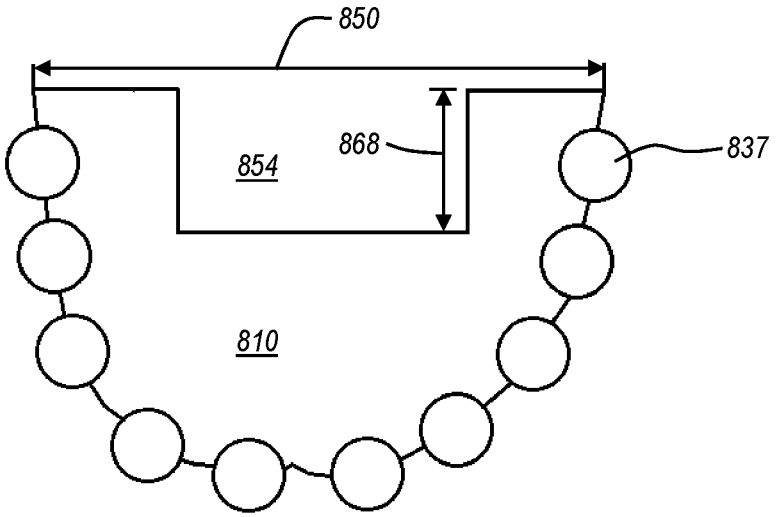
FIG. 8 is side view of a bit, according to at least one embodiment of the present disclosure.

FIG. 8 is a representation of an embodiment of a bit 810. The bit 810 may include a box connection 854 having a box length 868. In some embodiments, the box length 868 may be in a range having a lower value, an upper value, or lower and upper values including any of 0.5 in. (1.3 cm), 0.75 in. (1.9 cm), 1.0 in. (2.5 cm), 1.25 in. (3.2 cm), 1.5 in. (3.8 cm), 1.75 in. (4.5 cm), 2.0 in. (5.1 cm), 2.25 in. (5.7 cm), 2.5 in. (6.4 cm), 2.75 in. (7.0 cm), 3.0 in. (7.6 cm), 5.0 in. (12.7 cm), or any value therebetween. For example, the box length 868 may be greater than 0.5 in. (1.3 cm). In other examples, the box length 868 may be less than 3.0 in. (7.6 cm). In still other examples, the box length 868 may be any value in a range between 0.5 in. (1.3 cm) and 5.0 in. (12.6 cm), or between 1.0 in. (2.5 cm) and 3.0 in. (7.6 cm).

The bit 810 has a bit diameter 850. In some embodiments, a bit ratio may be the ratio of the bit diameter 850 to the box length 868. In some embodiments, the bit ratio may be between 2.5 and 5. For instance, the bit ratio may be 8.5:2

(17:4), 8:2.5 (16:5), 8.75:2.75 (35:11), 8.5:2.75 (34:11), 3:1, or any other ratio of bit diameter 850 to box length 868. In some embodiments, the bit ratio may be greater than 3:1 or less than 4.5:1. In some embodiments, the box length 868 may be at least partially dependent on the bit diameter 850. A longer box length 868 may be stronger, and a larger bit diameter 850 may incur greater forces on the box connection 854, thereby impacting the bit ratio. In some embodiments, however, the type of formation (e.g., formation 301 of FIG. 3) to be drilled through may affect the bit ratio. In some embodiments, at least one cutting element 837 (e.g., an active cutting element) of the bit 810 may axially overlap the box connection 854. In other words, at an axial position along a longitudinal axis of the bit 810, both a portion of the bod connection 854 and at least one cutting element 837 may be located. Thus, a radius extending through at least one cutting element 837 may extend through a portion of the box connection 854. Although the bit diameter 850 is shown relative to the bit body, in other embodiments, the bit diameter 850 is measured in relation to the gauge diameter of the bit (i.e., based on the cutting tip of the cutting elements 837).

Figure 9:
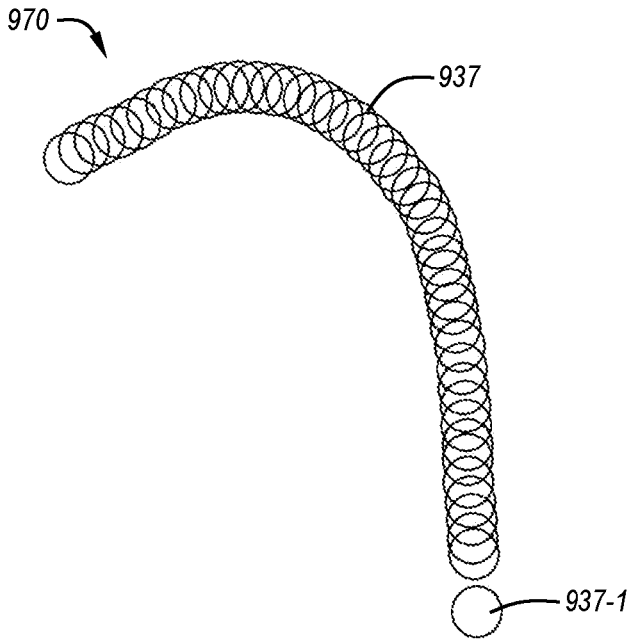
FIG. 9 is a representation of a composite cutting profile, according to at least one embodiment of the present disclosure.

FIG. 9 is a representation of a composite cutting profile 970, according to at least one embodiment of the present disclosure. The composite cutting profile 970 may be utilized in any of the bits described herein, specifically regarding the bits described in reference to FIG. 3 through FIG. 8. The composite cutting profile 970 is a representation of the radial and axial cutting position of each cutting element 937 on a bit (e.g., bit 310 of FIG. 3). The composite cutting profile 970 may include a final active cutting element 937-1 located in a gauge region of the bit. In some embodiments, the final active cutting element 937-1 may engage and remove a volume of material on a path through the formation (e.g., the formation 301 of FIG. 3) while the wellbore (e.g., wellbore 302 of FIG. 3) is being advanced in a downhole direction. The final active cutting element 937-1 (or cutting elements at the final active cutting element position 937-1) may be further uphole than cutting elements 937 at any other cutting element position on the cutting profile 970. Thus, the final active cutting element(s) 937-1 may be located the farthest uphole of any cutting elements 937. The final active cutting element(s) 937-1 may not be a backreaming cutting element, or configured to cut primarily while the bit is being pulled out of the wellbore, or to merely maintain the gauge diameter cut by a cutting element that is in a farther downhole position. Rather, the final active cutting element 937-1 may be configured to engage and cut a volume of the formation while the wellbore is advancing.

In some embodiments, the bit may include redundant or backup final active cutting elements 937-1. In some embodiments, a bit having multiple blades may have multiple, redundant cutting elements 937 located in the same radial and longitudinal position on each of two or more different blades. Cutting elements 937 located in the same longitudinal position on different blades are redundant because they cut the same rotational path. In this manner, placing multiple final active cutting elements 937-1 in the same radial and longitudinal position on multiple blades provides redundancy that can help improve the life of the final active cutting elements 937-1, which may experience greater wear than other cutting elements, as they can each actively remove a reduced total volume.

As may be seen in the composite cutting profile 970, if redundant or backup final active cutting elements 937-1 are placed on every blade of the bit (and if the blades do not include trailing cutters at other positions), none of the other cutting elements 937 may be at a position in the cutting profile 970 that overlaps the position of the final active cutting element 937-1. Placing redundant or backup final active cutting elements 937-1 on some but fewer than each of the blades (e.g., half, one-third, one-quarter, every other blade, and so forth), may allow some overlap of the positions of active cutting elements with the final active cutting element(s) 937-1 on the cutting profile 970.

Figure 10:
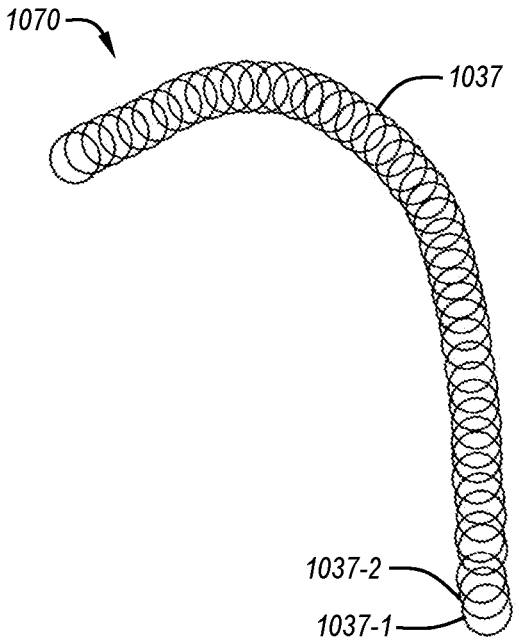
FIG. 10 is another representation of a composite cutting profile, according to at least one embodiment of the present disclosure.

FIG. 10 is a representation of a composite cutting profile 1070, according to at least one embodiment of the present disclosure. The composite cutting profile 1070 may be utilized in any of the bits described herein, specifically regarding the bits described in reference to FIG. 3 through FIG. 8. The composite cutting profile 1070 is a representation of the cutting path of each cutting element 1037 on a bit (e.g., bit 310 of FIG. 3). The composite cutting profile 1070 may include a first final active cutting element 1037-1 located in a gauge region of the bit. The first final active cutting element 1037-1 may be the uphole-most active cutting element 1037 (or multiple first final active cutting elements 1037-1). A second final active cutting element 1037-2 actively engages and removes formation farther uphole than any other cutting element 1037 except the first final active cutting element(s) 1037-1.

The first final active cutting element 1037-1 and the second final active cutting element 1037-2 may overlap in the cutting profile 1070 and may thus be located on different blades of the bit, or at leading and trailing positions on a single blade. Thus, in at least some embodiments, the first final active cutting element 1037-1 and the second final active cutting element 1037-2 may have overlapping cutting paths. In this manner, the cutting element angle (e.g., cutting element angle 766) may be fine-tuned along a length of the bit.

Figure 11:
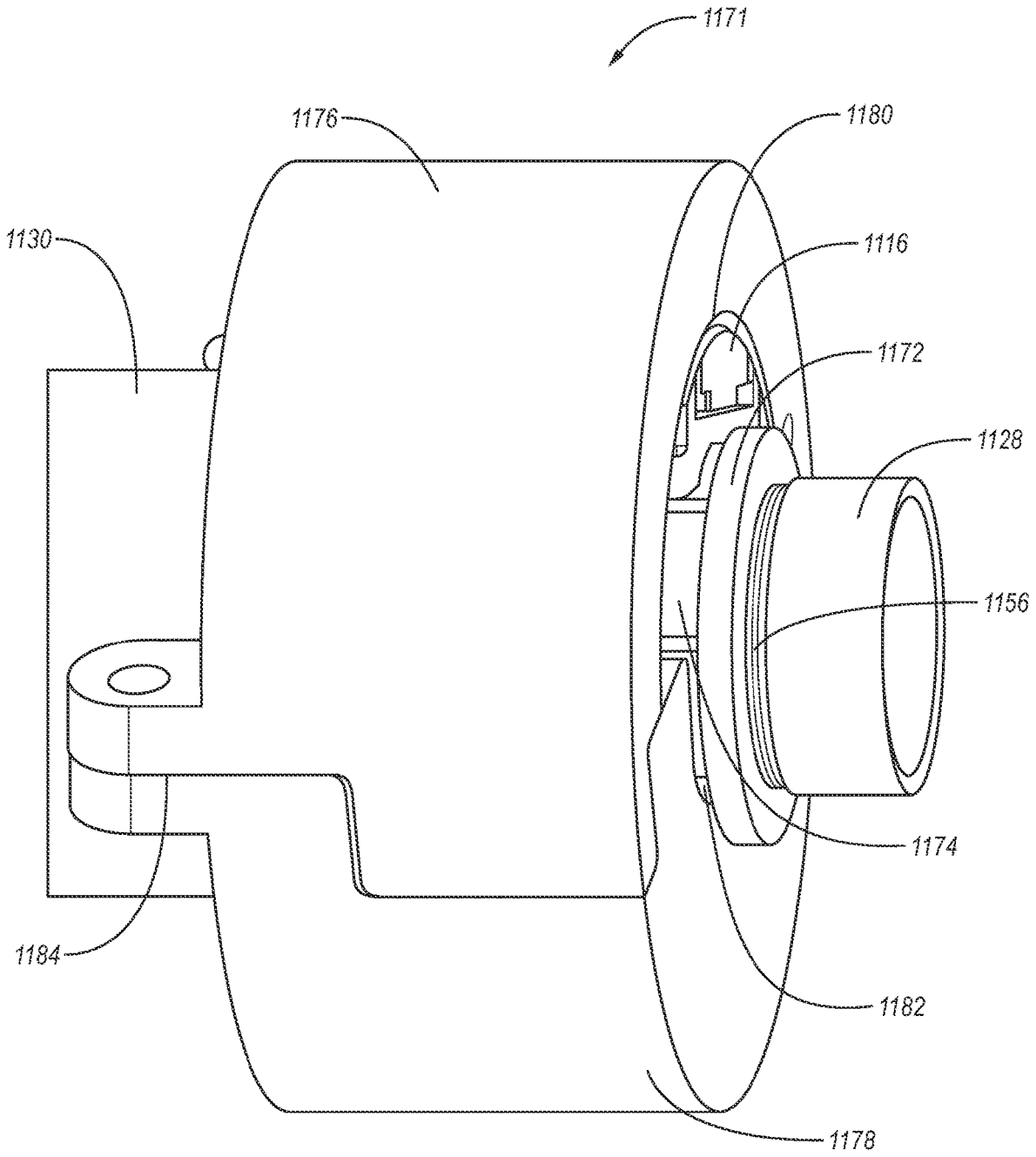
FIG. 11 is a side view of an assembly tool usable to connect a drive shaft to a drill bit, according to at least one embodiment of the present disclosure.

FIG. 11 illustrates an example assembly tool 1171 according to at least one embodiment of the present disclosure. A motor, drive shaft, or bias unit connection 1128 may include a connection shoulder 1172 and a plurality of keyed features 1174. In some embodiments, the connection 1128 may include eight flats spaced around the outer surface of the connection 1128, which flats cooperatively define a surface or connection feature allowing the assembly tool 1171 to hold the connection 1128 in place while a bit (e.g., bit 310, 410, 510, 610, 710, 810) can be rotated and secured thereto. In other embodiments, the assembly tool 1171 can be used to rotate the connection 1128 while another suitable device holds the bit in place.

While the connection 1128 is shown as having eight flats that define the keyed features 1174, the connection 1128 of the motor, drive shaft, or bias unit may have any suitable feature. In other embodiments, for instance, the bit connection 1128 may include 1, 2, 3, 4, 5, 6, 7, or more than 8 flats or other keyed features 1174. In some embodiments, the keyed features may include protrusions, recesses, slots, or holes that can be engaged by the assembly tool. Any suitable keyed features 1174 may be evenly spaced around a circumference of the connection 1128. In other embodiments, the keyed features 1174 may be unevenly spaced around the circumference of the connection 1128. For example, a larger slot or flat may correspond to a specific location on the assembly tool 1171, thereby aligning the connection 1128 with the assembly tool 1171.

The connection 1128 may be a pin connection that is coupled to a box connection (e.g., box connection 454 of FIG. 4) of a bit (e.g., bit 410 of FIG. 4). The connection 1128 may be attached to, or part of, a downhole tool, such as a drive shaft from a downhole motor, such as a turbine or a positive displacement motor (e.g., a Moineau pump). The downhole tool is optionally internal to, and rotatable relative to, a directional pad housing 1130. A directional pad 1116 (and optionally the portion of the directional pad housing 1130 supporting the directional pad 1116) may extend past, or overhang, the downhole end (e.g., downhole end 432 of FIG. 4) of the directional pad housing 1130. In some embodiments, the directional pad 1116 (and optionally the portion of the directional pad housing 1130 supporting the directional pad 1116) may extend over one or more of the plurality of keyed features 1174 and/or the connection shoulder 1172. The connection 1128 may include a threaded connection 1156, which may connect to corresponding threads on a bit.

To securely fasten the bit to the connection 1128 via the threaded connection 1156, the bit is rotated relative to the bit connection 1128 (or vice versa). The assembly tool 1171 may clamp onto the connection 1128 to restrict or even prevent the drive shaft or other downhole tool from rotating while the bit is fastened to the connection 1128. In the illustrated embodiment, the assembly tool has an upper portion 1176 and a lower portion 1178. The upper portion 1176 and the lower portion 1178 may have generally U-shaped radial cross-sectional areas to clamp around the connection 1128. The upper portion 1176 may have an upper cut-out 1180 that mates with a portion of one or more of the directional pad 1116, the directional pad housing 1130, or the keyed features 1174. For instance, the upper cut-out 1180 may be sized to pass over the connection 1128 and the directional pad 1116. One or more portions of the upper cut-out 1180 may then be sized and position to restrict rotation of the directional pad 1116 or directional pad housing 1130 when positioned as shown in FIG. 11. The lower portion 1178 may have a lower cut-out 1182 sized to connect to the connection 1128 at the plurality of keyed features 1174. The lower cut-out 1182 may include one or more protrusions or engaging surfaces sized to mate, engage, or interlock with one or more of the plurality of keyed features 1174. In some embodiments, the lower cut-out 1182 may include an indentation for a second pad (e.g., second pad 417 of FIG. 4) that may be supported by the directional pad housing 1130.

The upper portion 1176 and the lower portion 1178 may connect at an interface 1184. The interface 1184 may be used to clamp or otherwise secure the upper portion 1176 and the lower portion 1178 together (e.g., with a compressive force). The interface 1184 may be a bolted connection, a threaded connection, or any other connection or interface that aligns or secures the upper portion 1176 to the lower portion 1178 in the closed configuration shown in FIG. 11. In other words, when the interface 1184 is used to secure the upper portion 1176 to the lower portion 1178, the assembly tool 1171 clamps to the connection 1128 over the directional pad 1116. In this manner, with the one or more engaging surfaces of the lower portion 1178 mating or interlocking with one or more of the keyed features 1174, and potentially the surfaces of the upper cut-out 1180 restricting rotation of the directional pad 1116, the connection 1128 is rotationally fixed relative to the assembly tool 1171. Thus, a bit may be attached and tightened to the connection 1128 using the assembly tool 1171 to provide a counter-rotation force.

Figures 1, 12:
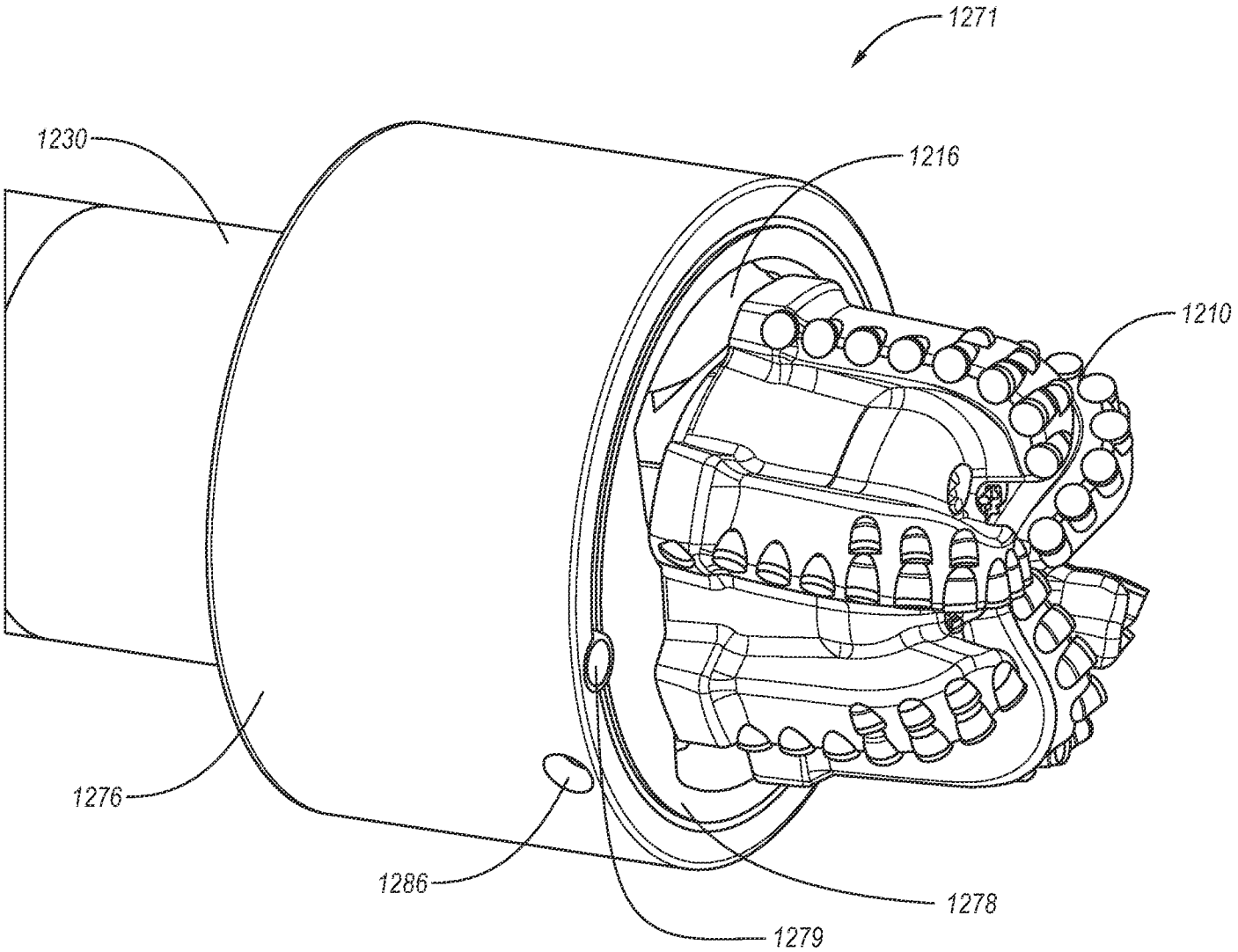
Figures 2, 12:
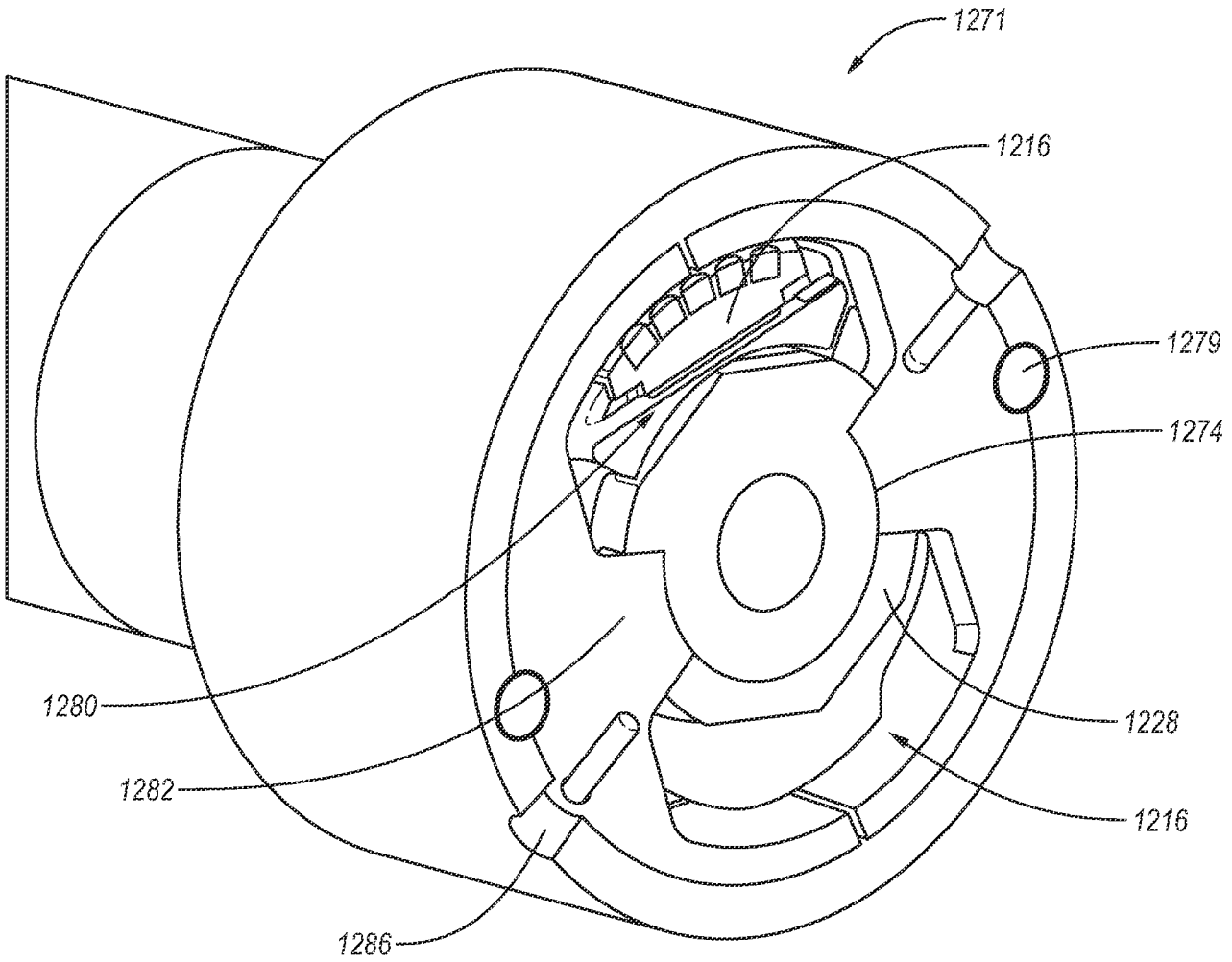

FIGS. 12-1 and 12-2 illustrate another example assembly tool 1271 according to at least one embodiment of the present disclosure. A motor, drive shaft, or bias unit connection 1228 may include a plurality of keyed features 1274. A shoulder may also be included as shown in FIG. 11, but is optional and may not be included in some embodiments.

In some embodiments, the connection 1228 includes two slots spaced around the outer surface of the connection 1228, which slots cooperatively define a surface or connection feature allowing the assembly tool 1271 to hold the connection 1228 in place while a bit 1210 can be rotated and secured thereto, or rotated around the bit 1210 while the bit 1210 is held in place. In contrast to the flats 1174 shown in FIG. 11, the slots 1274 may be deeper, and allow the application of higher torque. Further, in some embodiments, one or more flats or other surfaces may also be provided on the connection 1228 along with the slots 1274. In FIG. 12-2, for instance, two slots and four flats may be seen, although any suitable number of slots, flats, or the like can be used. Accordingly, as described herein, any suitable keyed features 1274 may be used, and may include one keyed feature, or multiple keyed features evenly or unevenly spaced around a circumference of the connection 1228.

The connection 1228 may be a pin connection that is coupled to a box connection (e.g., box connection 454 of FIG. 4) of the bit 1210. The connection 1228 may be attached to, or part of, a downhole tool, such as a drive shaft from a downhole motor, such as a turbine or a positive displacement motor. The downhole tool is optionally internal to, and rotatable relative to, a directional pad housing 1230. A directional pad 1216 (and optionally the portion of the directional pad housing 1230 supporting the directional pad 1216) may extend past, or overhang, the downhole end (e.g., downhole end 432 of FIG. 4) of the directional pad housing 1230, as described herein. In some embodiments, the directional pad 1216 (and optionally the portion of the directional pad housing 1230 supporting the directional pad 1216) extends at least partially over, and is axially aligned with, one or more of the plurality of keyed features 1274, flats, and/or the connection shoulder or pin connection of the connection 1228. The connection 1228 may include a threaded connection, which may connect to corresponding threads on the bit 1210.

To securely fasten the bit 1210 to the connection 1228 via the threaded connection, the bit 1210 is rotated relative to the bit connection 1228 (or vice versa). The assembly tool 1271 may fit around the connection 1228, and optionally into the keyed features 1274, to restrict or even prevent the drive shaft or other downhole tool from rotating while the bit 1210 is fastened to the connection 1228. In the illustrated embodiment, the assembly tool has an outer portion 1276 and an inner portion 1278. The inner portion 1278 may fit within the outer portion 1276, and is optionally rotationally secured therein using one or more pins 1279 or other fasteners. In some embodiments, there may be a single portion, rather than separate inner and outer portions 1276, 1278. As further shown, one or more openings 1280 may be formed in the outer portion 1276 and optionally the inner portion 1278. These openings may be used as a grip so that the assembly tool 1271 can be held in place. Of course, other mechanisms such as grips, keyed features, or the like may be used to otherwise hold the assembly tool 1271 in place.

The inner portion 1278 may have a cut-out 1280 that mates with a portion of one or more of the directional pad 1216, the directional pad housing 1230, or even keyed features (e.g., flats) of the connection 1228. For instance, the cut-out 1280 may be sized to pass over the connection 1228 and the directional pad 1216. One or more portions of the cut-out 1280 may then be sized and position to restrict rotation of the directional pad 1216 or directional pad housing 1230 when positioned as shown in FIG. 12-2. The inner portion 1278 may also have an engagement portion 1282 sized to connect to the connection 1228 at the plurality of slots 1274. The engagement portion 1282 may include one or more protrusions or engaging surfaces sized to mate, engage, fit within, or interlock with one or more of the plurality of keyed features 1274. In some embodiments, the inner portion 1278 may be symmetrical, or otherwise include a second cut-out 1280. The second cut-out 1280 may provide an opening for a second pad that may be supported by the directional pad housing 1230. In this manner, with the one or more engaging features 1282 (e.g., tabs) of the inner portion 1278 mating or interlocking with one or more of the keyed features 1274, and potentially the surfaces of the cut-out 1280 restricting rotation of the directional pad 1216, the connection 1228 is rotationally fixed relative to the assembly tool 1271. Thus, the bit 1210 may be attached and tightened to the connection 1228 using the assembly tool 1271 to provide a counter-rotation force.

The embodiments of the downhole directional drilling tool have been primarily described with reference to wellbore drilling operations; the downhole directional drilling tool described herein may be used in applications other than the drilling of a wellbore. In other embodiments, downhole directional drilling tool according to the present disclosure may be used outside a wellbore or other downhole environment used for the exploration or production of natural resources. For instance, downhole directional drilling tool of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. It should be understood that references to "one embodiment" or "an embodiment" of the present disclosure are not intended to be interpreted as excluding the existence of additional embodiments that also incorporate the recited features. For example, to simplify the discussion herein, some features are described with respect to particular embodiments. However, any features that are not mutually exclusive can be combined or interchanged. For instance, features of FIGS. 3-5 are interchangeable. Additionally, any other elements described in relation to an embodiment herein may be combinable with any element of any other embodiment described herein. For instance, the cutting profiles of any of FIGS. 6, 7, 9, and 10 may be defined by any of the bits of FIG. 3-5 or 8. Similarly, the bit of FIG. 8 may be used in any of the downhole tools of FIGS. 3-5.

Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole tool, comprising:

a directional pad configured to contact a wellbore wall at a pad contact location; and a drill bit comprising a longitudinal axis and having at least one active cutting element, the at least one active cutting element contacting the wellbore wall at a cutting element contact location, a contact length between the cutting element contact location and the pad contact location being up to 3 in. (7.6 cm), wherein the at least one active cutting element comprises one or more active cutting elements at a first position that is further uphole than every other active cutting element of the at least one active cutting element; and a directional pad angle between the pad contact location and the at least one active cutting element relative to the longitudinal axis, the directional pad angle being greater than 0° and less than or equal to 5°.

2. The downhole tool of claim 1, the drill bit having a bit diameter between 8 in. (20.3 cm) and 9 in (22.9 cm).

3. The downhole tool of claim 2, a contact ratio of the bit diameter to the contact length being greater than 3:1.

4. The downhole tool of claim 1, the drill bit being rotatable relative to the directional pad.

5. The downhole tool of claim 1, the directional pad being over-gauge relative to the bit, and the downhole tool having only one directional over-gauge pad.

6. The downhole tool of claim 1, the directional pad being coupled to a first portion of a directional pad housing, the directional pad extending longitudinally past a downhole end of a second portion of the directional pad housing.

7. The downhole tool of claim 1, the directional pad being coupled to a directional tool, and the drill bit including a box connection coupled to a pin connection of the directional tool, wherein the at least one active cutting element axially overlaps the box connection.

8. A downhole tool, comprising:

a housing;

a directional pad coupled to the housing and configured to contact a wellbore wall at a pad contact location; and a drill bit comprising a longitudinal axis and having at least one active cutting element and a bit diameter, a contact ratio of a diameter of the bit to a contact length between the at least one active cutting element and the contact location being greater than 3:1, wherein the at least one active cutting element is positioned at a first position located further uphole than every other active cutting element of the at least one cutting element that is not at the first position; and a directional pad angle between the pad contact location and the at least one cutting element relative to the longitudinal axis, the directional pad angel being greater than 0° and less than or equal to 5°.

9. The downhole tool of claim 8, the contact ratio being between 3:1 and 8.5:1.

10. The downhole tool of claim 8, further comprising a downhole motor including a drive shaft;

wherein the drill bit comprises a box connection coupled to a pin connection of the downhole motor, and the at least one active cutting element axially overlaps the box connection;

wherein the downhole tool comprises a directional pad housing coupled to the directional pad, and the drive shaft is internal to the directional pad housing.

11. The downhole tool of claim 10, the box connection having a box length, a bit ratio between a drill bit diameter and the box length being between 8.75:3 and 8.5:2.

12. The downhole tool of claim 8, the at least one active cutting element including at least one gauge cutting element, the directional pad having a pad radius greater than a cutting element radius of the at least one gauge cutting element.

13. The downhole tool of claim 8, comprising one or more second pads coupled to or integral with the housing, the one or more second pads each being angularly offset from the directional pad, wherein the directional pad has a greater radius and extends farther in a downhole direction than each of the one or more second pads.

14. The downhole tool of claim 8, the directional pad being radially fixed relative to a longitudinal axis of the downhole tool.

15. The downhole tool of claim 8, the directional pad being coupled to a first portion of the housing having a first downhole end, and extending longitudinally past a second downhole end of the housing that is between 120° and 180° offset from the first portion of the housing.

16. A downhole tool, comprising:

a directional pad configured to contact a wellbore wall at a contact location; and a drill bit having a longitudinal axis, the drill bit including:

a plurality of active cutting elements, including:

at least one first active cutting element located at a first position farther uphole than a position of every other active cutting element of the plurality of active cutting element elements not at the first position, a directional pad angle between the contact location and the first active cutting element relative to the longitudinal axis being greater than 0° and less than or equal to 5°; and a second active cutting element located at a second position farther uphole than every other active cutting element of the plurality of active cutting elements except those at the first position, an active cutting element angle between the first active cutting element and the second active cutting element relative to the longitudinal axis being greater than 0° and less than or equal to 5°.

17. The downhole tool of claim 16, a contact length between the contact location and the first active cutting element being up to 3 in. (7.6 cm).

18. The downhole tool of claim 16, the drill bit having a bit diameter and a ratio between the bit diameter and a contact length between the first active cutting element and the contact location being greater than 3:1.

19. The downhole tool of claim 16, the directional pad being coupled to a directional pad housing, the directional pad having an overhang relative to the directional pad housing.

* * * * *